US009712918B2

(12) United States Patent
Kessner

(10) Patent No.: US 9,712,918 B2
(45) Date of Patent: Jul. 18, 2017

(54) AUDIO PROCESSOR WITH BI-DIRECTIONAL INPUT/OUTPUT PORTS

(71) Applicant: QSC, LLC, Costa Mesa, CA (US)

(72) Inventor: David Dean Kessner, Westminster, CO (US)

(73) Assignee: QSC, LLC, Costa Mesa, CA (US)

( * ) Notice: Subject to any disclaimer, the term of this patent is extended or adjusted under 35 U.S.C. 154(b) by 0 days.

(21) Appl. No.: 15/002,135

(22) Filed: Jan. 20, 2016

(65) Prior Publication Data

US 2016/0353204 A1 Dec. 1, 2016

Related U.S. Application Data

(60) Provisional application No. 62/167,174, filed on May 27, 2015.

(51) Int. Cl.

| | |
|---|---|
| ***H04R 3/12*** | (2006.01) |
| ***H04R 3/00*** | (2006.01) |
| ***H04R 27/00*** | (2006.01) |
| *H04R 29/00* | (2006.01) |

(52) U.S. Cl.

CPC ..... *H04R 3/12* (2013.01); *H04R 3/005* (2013.01); *H04R 27/00* (2013.01); *H04R 29/004* (2013.01); *H04R 29/007* (2013.01)

(58) Field of Classification Search

CPC ..... H04W 76/02; H01R 29/00; H01M 2/30; H04J 3/06

USPC ..... 439/52; 345/519; 370/328; 429/178

See application file for complete search history.

(56) References Cited

U.S. PATENT DOCUMENTS

| | | | | |
|---|---|---|---|---|
| 6,538,656 | B1 * | 3/2003 | Cheung | G06T 9/007 345/519 |
| 2001/0014418 | A1 * | 8/2001 | Nemoto | H01M 2/30 429/178 |
| 2007/0054509 | A1 * | 3/2007 | Baek | H04N 5/268 439/52 |
| 2013/0100887 | A1 * | 4/2013 | Kim | H04W 76/026 370/328 |

* cited by examiner

*Primary Examiner* — Mohammad Islam
(74) *Attorney, Agent, or Firm* — Perkins Coie LLP

(57) ABSTRACT

An audio processor has a number of ports that are configurable as input or output ports. Each port includes a jack, an input audio circuit and an output audio circuit. A switch is controllable to selectively connect an output of the output audio circuit to the jack when the port is configured as an output port. In one embodiment, the switch is bypassed with resistor and the output of the output audio circuit is coupled through the resistor to the jack when the port is configured as an input port.

10 Claims, 4 Drawing Sheets

AUDIO PROCESSOR WITH BI-DIRECTIONAL INPUT/OUTPUT PORTS

CROSS-REFERENCE TO RELATED APPLICATIONS

This application claims priority to U.S. Provisional Patent Application No. 62/167,174 entitled "AUDIO PROCESSOR WITH BI-DIRECTIONAL INPUT/OUTPUT PORTS," and filed on May 27, 2015, which is hereby incorporated by reference in its entirety.

TECHNICAL FIELD

The disclosed technology relates to audio equipment and in particular to programmable audio processors.

BACKGROUND

Audio processors are sophisticated pieces of computer-controlled equipment that allow sound engineers to configure how sound is received and distributed in a space. Such equipment can be used in business establishments, bars, restaurants, conference rooms, concert halls, churches, government chambers or any other location where it is desired to receive audio inputs from a source and deliver it to one or more speakers for people to hear. One example of an audio processing system is the Q-Sys Core™ system available from QSC Audio Products, LLC.—the assignee of the present application.

A simplified representation of the Q-Sys Core system is shown in FIG. 1. The system 10 includes an audio processing core 20 that includes one or more central processing units 22 and audio processors 24 that can be implemented with programmable microprocessors or digital signal processors (DSPs). The audio processor 24 receives input audio signals from a number of audio input circuits 26 that condition the signals to have the proper level and if the signals received are in analog form, to convert the signals to corresponding digital signals with analog-to-digital converters. The audio signals are processed in the audio processor 24 and supplied to a selected audio output circuit 28 that may include an amplifier. The audio input signals are received from any number of input audio sources 40 including microphones 40*a*-40*c*, streamed audio signals from a network 40*d* including the Internet, digital music sources such as CD players 40*e* or MP3 players 40*f*. In addition, input signals can be received from satellite or cable television sources 40*g* or from a telephone 40*h*. As will be appreciated, other audio sources are also possible. Each of the audio sources is connected to the audio processor 20 through an input jack 30. The output audio signals are supplied via the audio processor's output jacks 32 to speakers 50*a*, 50*b* either directly or through additional amplifiers 60. Alternatively, the output audio signals can be transmitted on a network to other types of audio equipment (not shown). An audio engineer or IT technician is able to control how the audio signals are processed, combined and routed with software operating on the computer system 36.

One of the challenges in building audio processors 20 of the type shown in FIG. 1 is responding to customer demands for different numbers of inputs and outputs. One customer who is designing a large conference room may want a system with 16 microphone inputs and 8 speaker outputs, etc. Another customer designing a restaurant may want 4 signal inputs and 20 speaker outputs. In order to build systems to customer specifications large numbers of different input and output configurations must be kept in inventory.

Given this problem, there is a need for a way to simplify the design of the audio processor while still giving customers flexibility in how the system can be used.

SUMMARY

The technology disclosed herein relates to an improvement in audio processors. In particular, an audio processor includes a number of bi-directional input/output ports that are each configurable to accept audio signals from a source or to deliver audio signals to a load. In one embodiment, each bi-directional input/output port includes a jack that is electrically coupled to an input of the audio input circuit. A controllable switch selectively connects an output of the audio output circuit to the jack if the port is to be used as an output port. Alternatively, the switch can be controlled to disconnect the output of the audio output circuit from the jack if the port is to be used as an input port.

In one particular embodiment, each switch is bypassed with a resistor to allow the output of the audio output circuit to remain connected to the jack even when the port is configured as an input port.

DETAILED DESCRIPTION

To improve the manufacturability of an audio processor and to provide users increased flexibility in how the processor can be used; the disclosed technology provides an audio processor with a number of bi-directional input/output ports. Although the embodiment described is for use with audio, it will be appreciated that the technology can used in processing other signals e.g. video signals.

Figure 1:
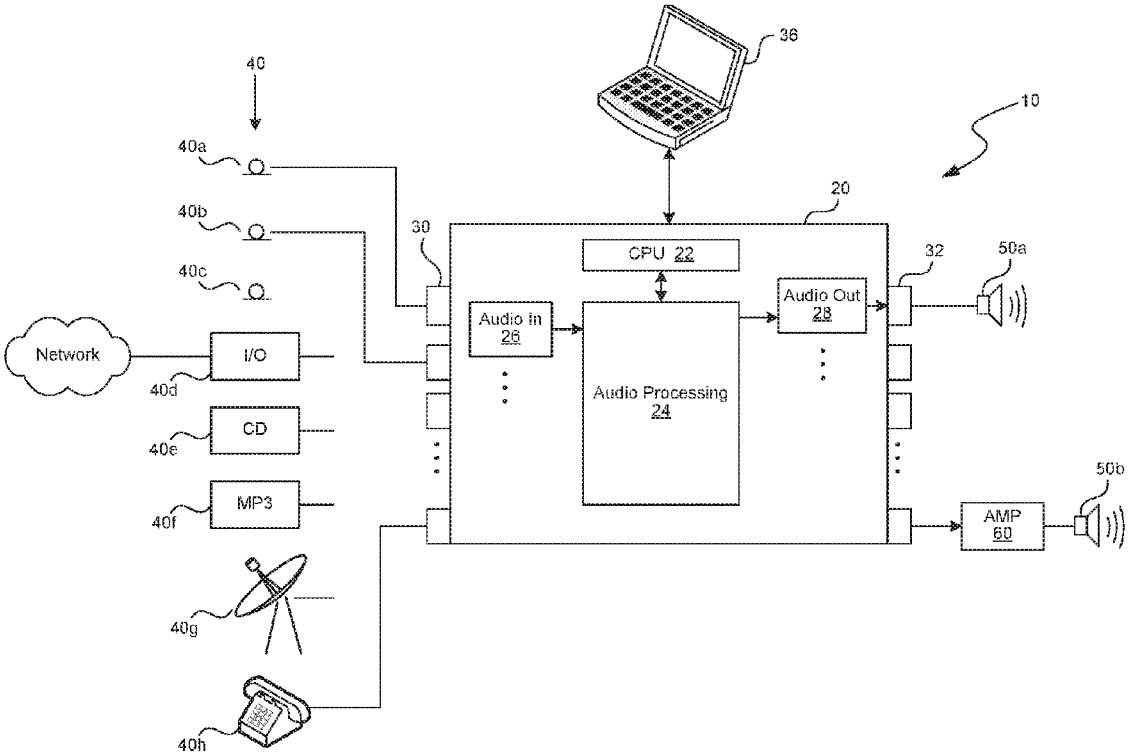
FIG. 1 (Prior Art)
FIG. 1 is a simplified block diagram of an audio processor including a number of input ports and output ports.
Figure 2:
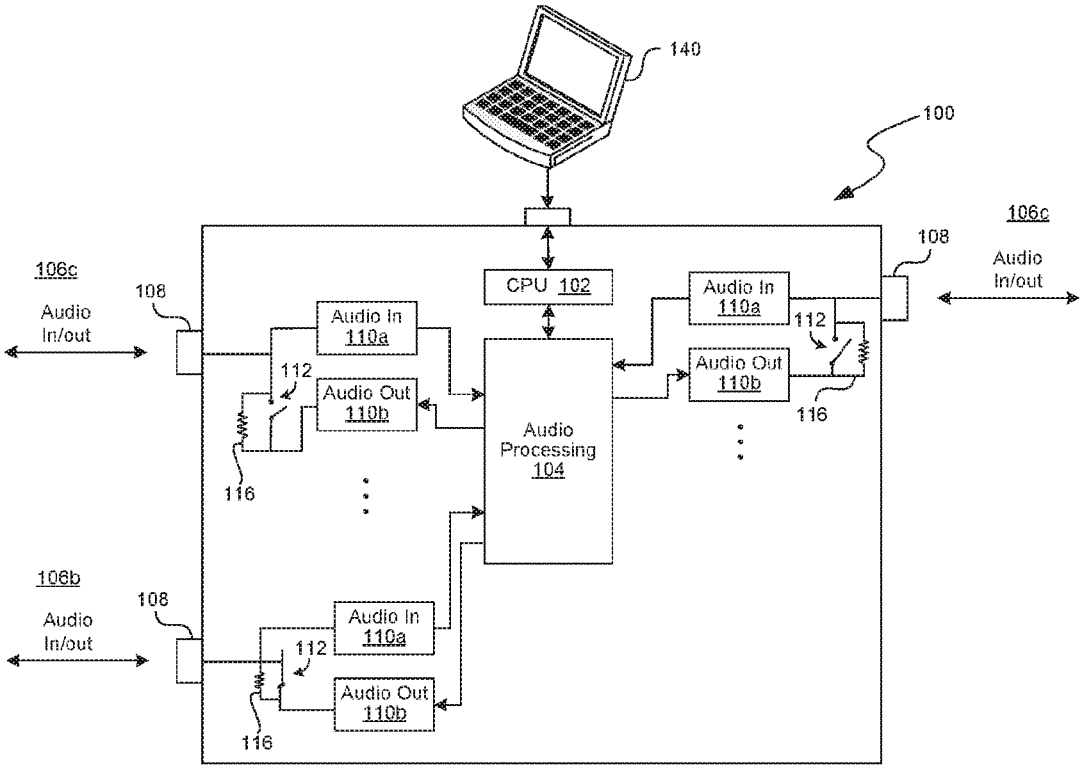
FIG. 2 is a simplified block diagram of an audio processor in accordance with one embodiment of the disclosed technology.

As shown in FIG. 2, an audio processor 100 includes one or more central processing units 102 and one or more audio processors/DSPs 104. The audio processor 104 is programmed to receive input audio signals from ports that are configured as input ports, process the signals and supply the processed signals to one or more output ports. In one embodiment, each of the ports to the audio processor is a bi-directional input/output port. In another embodiment, fewer than all the ports are bi-directional and some of the ports are permanently configured as either input or output ports.

In the embodiment shown, each bi-directional port 106*a*, 106*b* and 106*c* has a jack 108 that is electrically coupled to an input of an audio input circuit 110*a* and an output of an audio output circuit 110*b*. A switch 112 is controllable to connect or disconnect the output of the audio output circuit

110*b* from the jack 108 of the bi-directional port. When the switch 112 is closed, the output of the audio output circuit 110*b* is electrically connected to the jack of the bi-directional port. Conversely, when the controllable switch 112 is open, the output of the audio output circuit 110*b* is not directly connected to the jack of the bi-directional port.

In one embodiment, the switches 112 are electromechanical relays that are controlled to be in the open or closed state by the signals produced by the CPU 102. However it will be appreciated that other types of switches such as solid-state relays or transistor switches could also be used.

To configure a port as an input port, a user employs a computer program on a computer system 140 and designates the port as an input port. Signals from the computer system 140 are provided to the CPU 102 that in turn causes the CPU 102 to produce a control signal that opens the switch 112. The details of the programming and support circuitry used to enable the CPU 102 to change the state of the switches are considered to be well known to those of ordinary skill in the art. In one embodiment, the CPU 102 includes non-volatile memory to remember the desired state of the switches 112 after power to the audio processor 100 has been removed. In one embodiment, each bi-directional port remains configured as either an input port or an output port after power is restored to the audio processor until it's state is changed by a user.

In another embodiment, the audio processor 100 can include an input mechanism (e.g., keypad, touch screen, buttons or switches and the like) that can be used to set the bi-directional ports to be either input ports or output ports without the use of the computer 140. Alternatively, jumpers can be placed on the circuit board to set the position of the switches or manual switches could be used.

In one embodiment of the disclosed technology, each of the switches 112 is bypassed with by a resistor 116 that is in parallel with the switch. The resistor 116 has a fairly large resistance such as, but not limited to 20 K-300 K ohms and in one particular embodiment has a resistance of 150 K ohms. With the resistor 116 in place, the output of the audio output circuit 110*b* is always connected to the jacks of the bi-directional ports. When the switch 112 is open, the output of the audio output circuit 110*b* is connected through the resistor 116 to the jack of the bi-directional switch and to the input of the audio input circuit 110*a*. When the switch 112 is closed, the output of the audio output circuit 110*b* is connected by a much lower impedance to the jack of the bi-directional port and to the input of the audio input circuit 110*a*.

Although the bi-directional ports can be constructed without the resistor 116 in parallel with the switch 112, the resistor provides some useful benefits.

Figure 3:
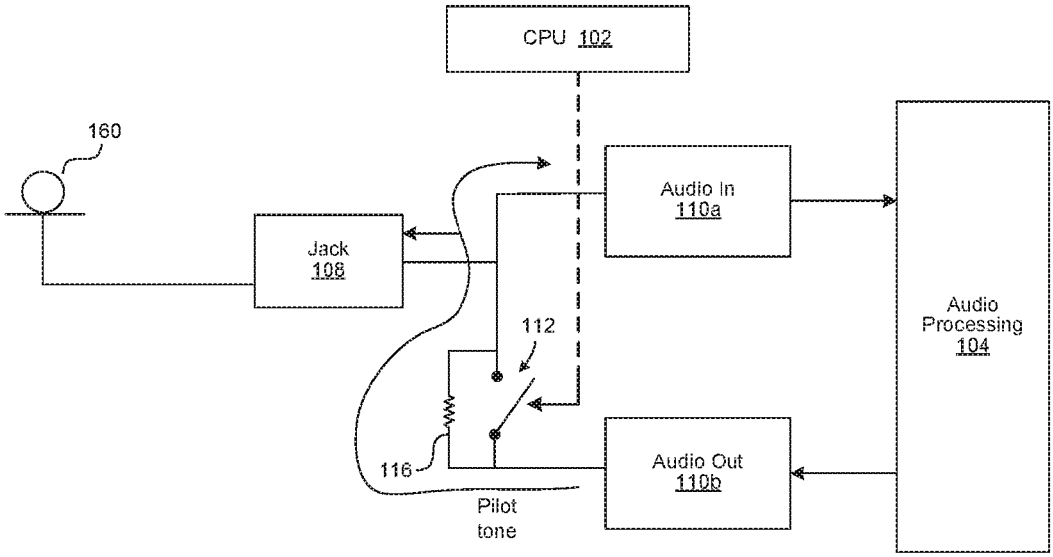
FIG. 3 illustrates a controllable switch that selectively connects an output of an audio output circuit to a jack of a bi-directional port in accordance with one embodiment of the disclosed technology.

FIG. 3 shows an arrangement where the switch 112 is controlled by the CPU 102 to be in an open state. This configures the bi-directional port to behave as an input port. An input signal such as from a microphone 160 is supplied to the input of the audio input circuit 110*a* for processing by the audio processor 104. In order to test that the microphone is operating properly, a pilot tone is produced by the audio output circuit 110*b*. The signal for the pilot tone passes through the resistor 116 and is electrically coupled to the jack 108 and to the input of the input circuit 110*a*. The level of the signal for the pilot tone that is detected at the input of the audio input circuit 110*a* depends on whether there is a fault with the microphone 160. This is useful when the audio system is part of a public address (PA) system and the microphone is to be used in case of emergencies or other instances where a microphone is needed. If the microphone is not present or could be damaged, the CPU 102 can produce a warning message to an operator of the system to check the microphone 160.

Figure 4:
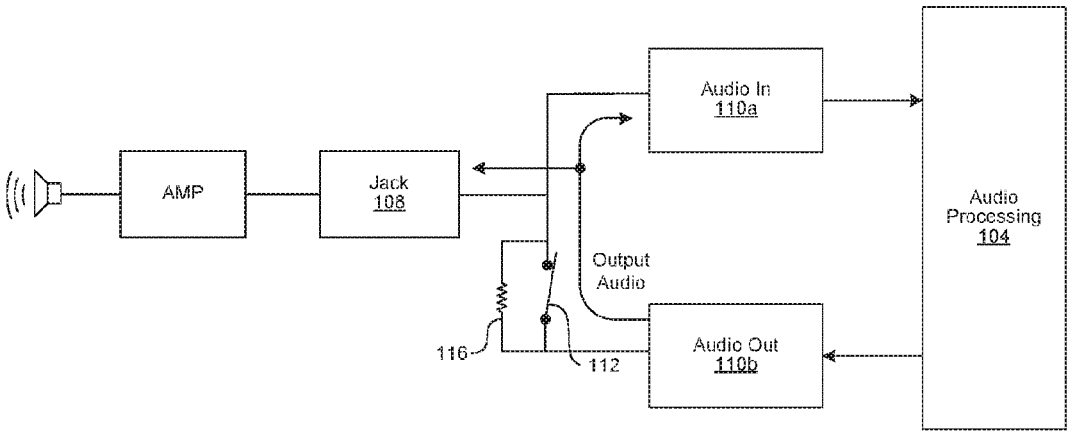
FIG. 4 illustrates the controllable switch in a position to electrically connect an output of the audio output circuit to a jack of a bi-directional port in accordance with an embodiment of the disclosed technology.

FIG. 4 shows an example of when the switch 112 is closed and the bi-directional port is configured as an output port. Here, the output of the audio output circuit 110*b* is coupled by the low impedance switch 112 to the jack 108 and also to the input of the audio input circuit 110*a*. By monitoring the signal at the input of the input audio circuit 110*a*, the audio processor 104 and/or the CPU 102 can determine if there is a short in the load or other error conditions. As will be appreciated, the input of the audio input circuit 110*a* should be sufficiently protected to withstand the level of the signals produced by the audio output circuit 110*b*.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus.

A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium also can be, or can be included in, one or more separate physical components or media (e.g., multiple CDs, disks, or other storage devices). The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus also can include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus ((USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., an LCD (liquid crystal display), LED (light emitting diode), or OLED (organic light emitting diode) monitor, for displaying information to the user and a keyboard and a pointing device, e.g., a mouse or a trackball, by which the user can provide input to the computer. In some implementations, a touch screen can be used to display information and to receive input from a user. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include any number of clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. An audio processor, comprising:

a central processing unit;

an audio processor; and a number of ports wherein at least some of the ports are bi-directional and are configurable by the central processing unit to supply signals to, or receive signals from, the audio processor, wherein each bi-directional port includes:

a jack;

an input audio circuit electrically connected to the jack;

an output audio circuit;

a switch that is configured to connect an output of the output audio circuit to the jack when the bi-directional port is configured as an output; and a resistor that connects the output of the output audio circuit to the jack when the bi-directional port is configured as an input.

2. An audio processor, comprising:

a central processing unit;

an audio processor; and a number of ports wherein at least some of the ports are bi-directional and are configurable by the central processing unit to supply signals to, or receive signals from, the audio processor, wherein each bi-directional port includes:

a jack;

an input audio circuit electrically connected to the jack;

an output audio circuit; and a switch that is controlled by a signal from the central processing unit to selectively connect an output of the output audio circuit to the jack through a low impedance path when the bi-directional port is configured as an output port; and a resistor that connects the output of the output audio circuit to the jack through a higher impedance path when the bi-directional port is configured as an input port.

3. An audio processor, comprising:

a central processing unit;

an audio processor; and a number of ports, wherein at least some of the ports are bi-directional and are configurable by the central processing unit to supply signals to, or receive signals from, the audio processor, wherein each port includes:

a jack;

an input audio circuit electrically connected to the jack;

an output audio circuit;

a switch that is controlled by a signal from the central processing unit to directly connect an output of the output audio circuit to the jack when bi-directional port is configured as an output port;

a resistor connected between the output of the output audio circuits and the jack when the bi-directional port is configured as an input port.

4. A processor, comprising:

a central processing unit;

a processor circuit for processing an input signal;

a number of ports wherein at least some of the ports are bi-directional;

a jack, an input circuit and an output circuit associated with each bi-directional port; and a switch that selectively connects an output of the output circuit to the jack of the bi-directional port when the bi-directional port is configured as an output port, wherein the switch is bypassed with a resistor that couples the output of the output circuit to the jack when the bi-directional port is configured as an input port.

5. The processor of claim 4, wherein an input of the input circuit is connected to the jack and remains connected to the jack when the bi-directional port is configured as an output port.

6. The processor of claim 4, wherein the switch is controlled with a signal from the central processing unit.

7. The processor of claim 4, wherein the switch is controlled manually.

8. An audio processor, comprising:

a central processing unit;

an audio processor; and a number of bi-directional ports;

wherein each bi-directional port includes:

a jack;

an input audio circuit electrically connected to the jack;

an output audio circuit;

a switch electrically connected between an output of the output audio circuit and the jack, wherein the switch is configured to selectively connect the output of the output audio circuit to the jack when the bi-directional port is configured as an output; and a resistor that connects the output of the output audio circuit to the jack when the bi-directional port is configured as an input.

9. The audio processor of claim 8, wherein the switch is controlled by the central processing unit.

10. The audio processor of claim 8, wherein the switch is controlled manually.

* * * * *